US009743790B2

(12) United States Patent
Achterhuis

(10) Patent No.: US 9,743,790 B2
(45) Date of Patent: Aug. 29, 2017

(54) ILLUMINATION ASSEMBLY FOR PROVIDING A CHRISTMAS TREE IMPRESSION

(71) Applicant: HEMSSON HOLDING B.V., Enter (NL)

(72) Inventor: Herman Johan Achterhuis, Wierden (NL)

(73) Assignee: HEMSSON HOLDING B.V., Enter (NL)

( * ) Notice: Subject to any disclaimer, the term of this patent is extended or adjusted under 35 U.S.C. 154(b) by 12 days.

(21) Appl. No.: 14/892,954

(22) PCT Filed: Oct. 4, 2013

(86) PCT No.: PCT/NL2013/050708
§ 371 (c)(1),
(2) Date: Nov. 20, 2015

(87) PCT Pub. No.: WO2014/189365
PCT Pub. Date: Nov. 27, 2014

(65) Prior Publication Data

US 2016/0088968 A1 Mar. 31, 2016

(30) Foreign Application Priority Data

May 21, 2013 (NL) ..... 2010828

(51) Int. Cl.
*F21S 4/00* (2016.01)
*F21V 21/00* (2006.01)
(Continued)

(52) U.S. Cl.
CPC ..... *A47G 33/06* (2013.01); *F21S 4/20* (2016.01); *F21V 21/16* (2013.01);
(Continued)

(58) Field of Classification Search
CPC ..... A47G 33/04; A47G 33/06; A47G 2033/0827; F21S 4/10; F21S 4/15;
(Continued)

(56) References Cited

U.S. PATENT DOCUMENTS 2,911,748 A * 11/1959 Rodgers ..... A47G 33/06 211/200
3,677,867 A 7/1972 Westlung
(Continued)

FOREIGN PATENT DOCUMENTS

EP 1 710 772 B1 6/2011

*Primary Examiner* — Alexander Garlen
(74) *Attorney, Agent, or Firm* — Birch, Stewart, Kolasch & Birch, LLP

(57) ABSTRACT

Illumination assembly for providing a Christmas tree impression, comprising at least two bands which in a set up condition of the illumination assembly, seen in side view of the illumination assembly, bound a triangular area. At least one string of lights extends zigzag in the associated triangular area and is connected via light string fastening elements with the bands. With the aid of band fastening elements and top fastening means, the bands are positioned and kept in a tensed condition relative to a fixed external object, such as a pole, a wall, a door and/or a tree. The illumination assembly is arranged to be brought from a packaged condition to the set up condition and vice versa.

18 Claims, 8 Drawing Sheets

(51) Int. Cl.

| | |
|---|---|
| ***A47G 33/06*** | (2006.01) |
| ***F21S 4/20*** | (2016.01) |
| ***F21V 21/16*** | (2006.01) |
| *F21S 4/10* | (2016.01) |
| *A47G 33/08* | (2006.01) |
| *F21W 121/04* | (2006.01) |

(52) U.S. Cl.
CPC ..... *A47G 2033/0827* (2013.01); *F21S 4/10* (2016.01); *F21W 2121/04* (2013.01)

(58) Field of Classification Search
CPC .... F21S 4/20; F21S 4/22; F21V 21/16; F21V 21/22; F21W 2121/04
See application file for complete search history.

(56) References Cited

U.S. PATENT DOCUMENTS

| | | | | | |
|---|---|---|---|---|---|
| 3,857,748 | A | | 12/1974 | Thomann | |
| 5,454,188 | A | * | 10/1995 | Sofy | A47G 33/12 248/523 |
| 5,712,002 | A | * | 1/1998 | Reilly, III | A47G 33/06 211/196 |
| 6,062,701 | A | | 5/2000 | Hines | |
| 6,254,250 | B1 | * | 7/2001 | Shieh | A47G 33/06 362/123 |
| 6,361,187 | B1 | | 3/2002 | Adams | |
| 6,379,021 | B1 | * | 4/2002 | Shieh | A47G 33/06 362/123 |
| 2006/0254100 | A1 | * | 11/2006 | Gierveld | F21S 4/10 40/538 |
| 2008/0165525 | A1 | * | 7/2008 | Chang | F21S 4/20 362/123 |

* cited by examiner

ILLUMINATION ASSEMBLY FOR PROVIDING A CHRISTMAS TREE IMPRESSION

FIELD

The invention relates to an illumination assembly for the purpose of providing a Christmas tree impression.

BACKGROUND

An illumination assembly for providing a Christmas tree impression is known from EP-1 710 772 (B1). The known illumination assembly comprises at least two annular elements. The annular elements are mutually interconnected by a number of bands which extend from a central top downwards and radially outwards. When the illumination assembly has been set up, the bands extend substantially in a conical surface, with the top of the cone formed by the earlier-mentioned central top. The annular elements each extend in an associated horizontal plane, which intersects the conical surface. The diameter of the at least two annular elements is chosen such that the annular elements also extend substantially in the conical surface. When using two annular elements located at different heights, these two annular elements therefore have different diameters and extend in two horizontal planes located one above the other. The annular elements are provided to ensure that the bands each do indeed extend substantially in the conical surface. On the bands, loops are mounted which can be opened and closed with press studs. Between two neighboring bands a string of lights is mounted in a zigzag pattern. The mounting of the string of lights is realized with the loops. To facilitate mounting, in the known illumination assembly the string of lights is provided with color markings, so that it is clear at which points of the string of lights this string of lights is to be connected with a band by means of a loop. The markings are provided such that in a set up condition of the illumination assembly, the string of lights has a garland-like configuration in stretches between the two neighboring bands. In this context, garland-like configuration is understood to mean the configuration of a catenary curve. Owing to the garland-like configuration, an excellent Christmas tree impression is provided, while the positioning of the lights along the garland or catenary curve leads to the impression that they have been provided on the branches of a Christmas tree. To assemble the known illumination assembly, first the two annular elements have to be created. In the version as marketed, the annular elements are formed by a kind of tent pole-like elements which are known for dome tents. These tent pole-like elements comprise a number of flexible pole parts which can be mutually connected by means of metal shaft parts and can be formed into a kind of hoop. In the interior of the pole parts, which are of hollow design, an elastic cord extends which ensures that the pole parts are pulled into the shaft parts, so that the hoop does not fall apart easily. Hence, forming the annular elements is realized by inserting the pole parts into the shaft parts and thus forming a hoop. Next, the hoops or annular elements are to be connected with the bands. This can be realized, for instance, in that the bands are provided with further loops which can be opened and closed in that they are provided with Velcro. Finally, the strings of lights have to be mounted on the bands. The greater part of these strings of lights can be pre-assembled in the factory, but at least one string of lights must be mounted by the purchaser, because otherwise the known illumination assembly cannot be arranged around the pole from which the illumination assembly is suspended. The known illumination assembly is suitable in particular for mounting to an existing flagpole. The central point where the bands meet is formed by a ring or eye with which each band is connected. The ring can be connected with the hoisting rope of the flagpole and the entire illumination assembly can thus be hoisted by the ring or the eye, so that the bands extend from the lower annular element to the ring. During mounting of the last string of lights, it is necessary to hoist the illumination assembly a bit further up each time because when mounting a string of lights near the ring or the eye, the illumination assembly cannot be fully hoisted yet. In some versions, the known illumination assembly can be as high as 6-10 meters.

All in all, setting up the known illumination assembly is a time consuming activity. Moreover, with this kind of products, there is always a need for further cost reduction as there is a great price pressure in the market.

SUMMARY

The object of the invention is to provide an illumination assembly which can be mounted faster and which can be manufactured inexpensively and yet gives a high quality rendering of a real Christmas tree.

To that end, the invention provides an illumination assembly according to claim 1. More particularly, the invention provides an illumination assembly for providing a Christmas tree impression, the illumination assembly comprising:

- at least two bands each having a first end and a second end, wherein the at least two bands in a set up condition of the illumination assembly extend from a common apical range, in which the first ends of the at least two bands are located, in downward direction and, viewed from the apical range, extend away from each other, such that two neighboring bands, seen in side view of the illumination assembly, bound a triangular area;
- at least one string of lights which, in the set up condition of the illumination assembly, extends zigzag-wise in the associated triangular area between two neighboring bands of the at least two bands, while the at least one string of lights is connected with those two neighboring bands;
- light string fastening elements which are configured for connecting the at least one string of lights with the bands;
- band fastening elements which are each connected with an associated second end of the at least two bands;
- top fastening means for positioning in the apical range the first ends of the at least two bands relative to a fixed, external object, such as a pole, a wall, a door or a tree, such that the apical range in the set up condition is at a particular level above the ground;

wherein the illumination assembly is arranged to be brought from a packaged condition to the set up condition and vice versa, and wherein in the set up condition the at least two bands are held in tensed condition with the aid of the band fastening elements in that the second ends are connected via the band fastening elements with a fixed object such as the ground, a wall, a door and/or a tree and in that the top fastening means are connected with a fixed object such as a pole, a wall, a door or a tree.

Such an illumination assembly is particularly simple and yet provides a very good impression of a Christmas tree. The illumination assembly according to the invention does not comprise any annular elements or hoops extending in a horizontal plane, with which the bands are connected. As stated, such annular elements or hoops were present for positioning the bands, such that these bands would extend substantially in a conical surface. The absence of the annular elements or hoops saves a considerable amount of work in setting up the Christmas tree, namely, the above described forming of the hoops and connecting the bands to the hoops. Furthermore, the absence of the hoops saves costs, not only because the pole parts and the shaft parts from which the hoops are to be formed do not need to be supplied, but also because in the production of the illumination assembly, no costly labor needs to be performed for providing connecting means such as Velcro loops on the bands for the purpose of providing a connecting means for connecting the hoops to the bands. The illumination assembly according to the invention can therefore be mass produced well, at relatively low costs. In the known illumination assembly the bands were provided with lots of loops with press studs. This was a highly labor intensive activity in production, which had a cost-raising effect. With the light string fastening elements this is no longer necessary either. In an embodiment, as will be extensively elucidated hereinafter, these light string fastening elements can be implemented as a one-piece plastic part which can be simply mass produced, for instance by means of injection molding.

Yet another advantage is that the illumination assembly according to the invention does not have the limitation of being suspendible only from a pole around which free space is available for accommodating the circular hoops, since such circular hoops are no longer present. When a shrub is disposed somewhere, one of the bands can be connected to the ground at a different position, so that the shrub is not in the way anymore. It is even possible to set up the bands in one plane, for instance against a wall or a door.

In an embodiment, the illumination assembly can comprise a number of separate strings of lights, with each string of lights extending zigzag between a respective pair of neighboring bands. This has as an advantage that in case of failure of one of the strings of lights, not all lights have to be replaced, but only one string of lights needs to be replaced.

In an alternative embodiment, the illumination assembly can comprise a single string of lights which extends zigzag between two neighboring bands. When more than two bands are involved, and hence also more than one triangular area bounded by neighboring bands is involved, there may also be, instead of several strings of lights, just a single string of lights extending in zigzag configuration in a first triangular area and then continuing to another triangular area between two neighboring bands, and there zigzagging between them again, and so forth. Thus, with a single string of lights, all triangular areas between neighboring bands can be provided with a zigzag suspended light string area.

Further elaborations of the invention are described in the subclaims and will be clarified in more detail in the following on the basis of three exemplary embodiments, with reference to the drawings.

DETAILED DESCRIPTION

Figure 6:
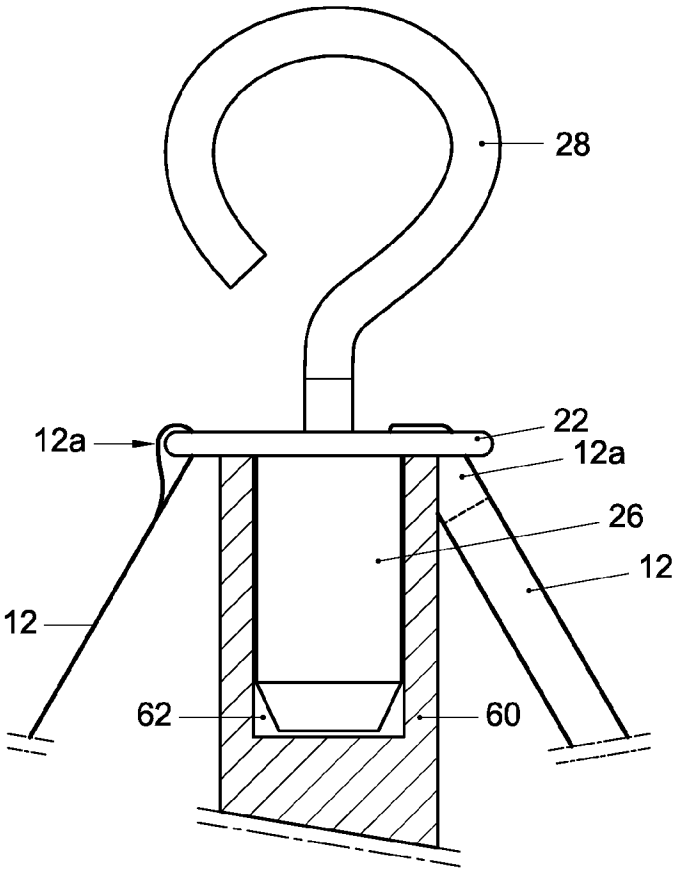
FIG. 6 shows a side view of the exemplary embodiment of FIG. 5.
Figure 7:
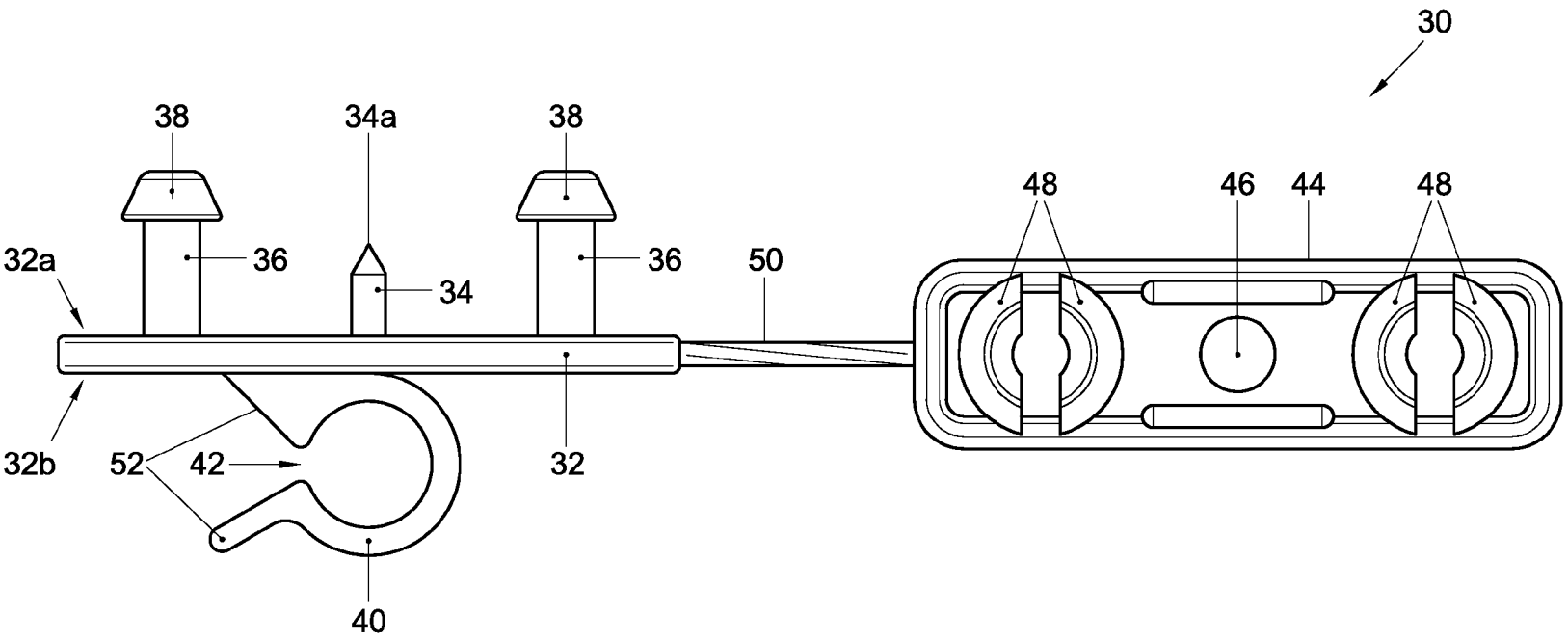
FIG. 7 shows a perspective view of an exemplary embodiment of a light string fastening element in opened condition.
Figure 8:
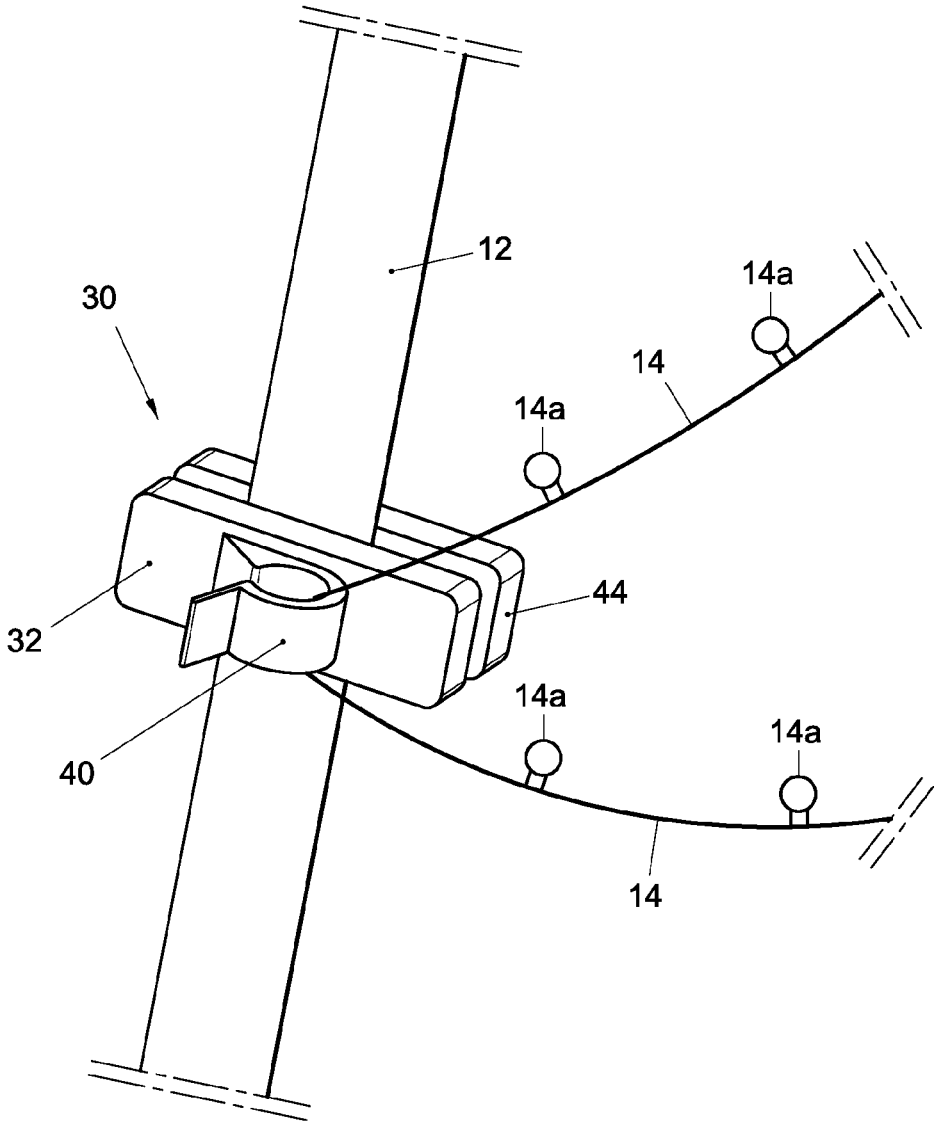
FIG. 8 shows a perspective view of the exemplary embodiment of FIG. 7 in closed condition while clamping a band.

FIGS. 1-4 and 9-11 show three examples of an illumination assembly 10 for providing a Christmas tree impression. FIGS. 5 and 6 show an example of a top fastening element and FIGS. 7 and 8 show an example of a light string fastening element.

It is expressly pointed out that in the following text, various embodiments are described on the basis of the examples of the figures. The examples only serve for illustration. Embodiments can also be realized in another manner than shown. The various embodiments described in the following can furthermore be applied independently of each other in an illumination assembly 10. On the other hand, the various embodiments can also be combined with one another.

In the most general terms, the illumination assembly 10 for providing a Christmas tree impression comprises at least two bands 12, each having a first end 12*a* and a second end 12*b*. The at least two bands 12 in a set up condition of the illumination assembly 10 extend from a common apical range, in which the first ends 12*a* of the at least two bands 12 are located, in downward direction and, viewed from the apical range, extend away from each other such that two neighboring bands, seen in side view of the illumination assembly 10, bound a triangular area. The illumination assembly 10 further comprises at least one string of lights 14 which, in the set up condition of the illumination assembly 10, extends zigzag in the associated triangular area between two neighboring bands of the at least two bands 12. Here, the at least one string of lights 14 is connected with those two neighboring bands 12. To this end, the illumination assembly 10 comprises light string fastening elements 30 which are configured for connecting the at least one string of lights 14 with the bands 12. To connect the bands 12 with a fixed object, such as a pole, a wall, a door or a tree, the illumination assembly comprises band fastening elements 16 which are each connected with an associated second end 12*b* of the at least two bands 12. For the purpose of positioning the first ends 12*a* of the at least two bands 12 relative to a fixed external object, such as a pole, a wall, a door or a tree, the illumination assembly 10 comprises top fastening means 20; 64; 66 with the aid of which the apical range in the set up condition of the illumination assembly 10 is positioned at a particular level above the ground. The illumination assembly 10 can be brought from a packaged condition to the set up condition and vice versa. In the set up condition, the at least two bands 12 are held in a tensed condition with the aid of the band fastening elements 16, 18 in that the second ends 12*b* are connected via the band fastening means 16, 18 with a fixed object such as the ground G, a wall, a door and/or a tree and in that the top fastening means 20, 64, 66 are connected with a fixed object such as a pole 60, a wall, a door D or a tree.

For the advantages obtained with such an illumination assembly, reference is made to the "SUMMARY" in which they are extensively discussed. A string of lights 14 is understood to mean an electrically conductive cord bearing lights 14*a*. The lights 14*a* may for instance be implemented as LEDs.

In an embodiment, of which an example is shown in the figures, each band fastening element 16, 18 can comprise an elastic 16, the elastic being connected to the second end 12*b* of the associated band 12. The elastics provide a better possibility of guaranteeing the tension on the bands for a longer period of time. Also, there is somewhat more play regarding the connection of the elastic 16 with the fixed world, such as the ground, a wall, a door D or a similar object.

In an embodiment, of which an example is shown in the figures, at least a number of the band fastening elements 16, 18 can comprise a tent peg 18, the at least one peg 18 in the set up condition of the illumination assembly engaging an associated elastic 16.

The peg 18 is driven into the ground and the elastic 16 is hooked to the peg. With this, in a simple manner, a stable connection between the fixed world and the respective band 12 is realized which, moreover, guarantees that the tension on the band is maintained for a longer period of time. Instead of using a peg 18, attachment to the fixed world can also be realized using other means, for instance with a hook or eye fixed to a wall or in the ground.

Figure 9:
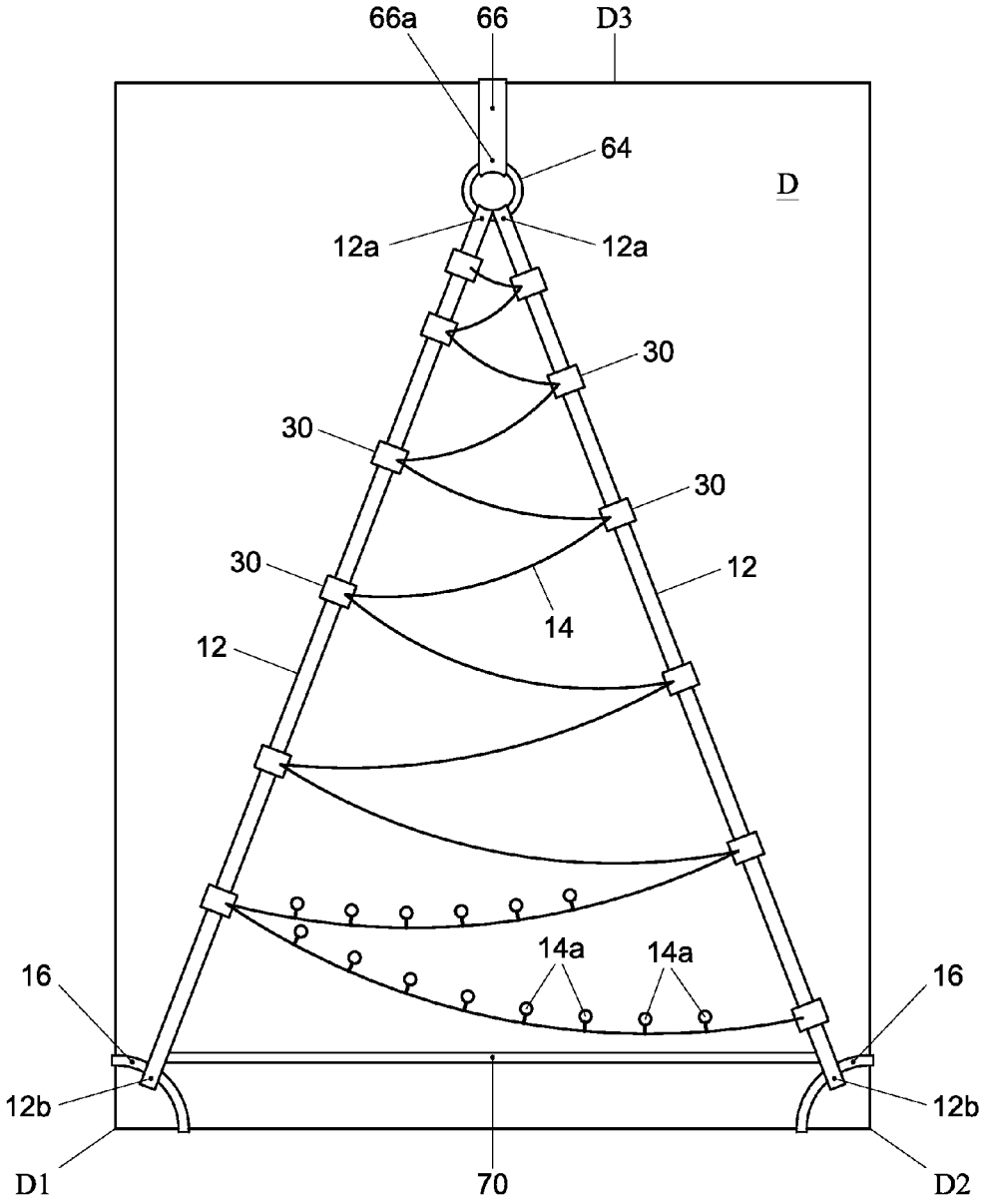
FIG. 9 shows a front view of a second exemplary embodiment, mounted on a door.
Figure 10:
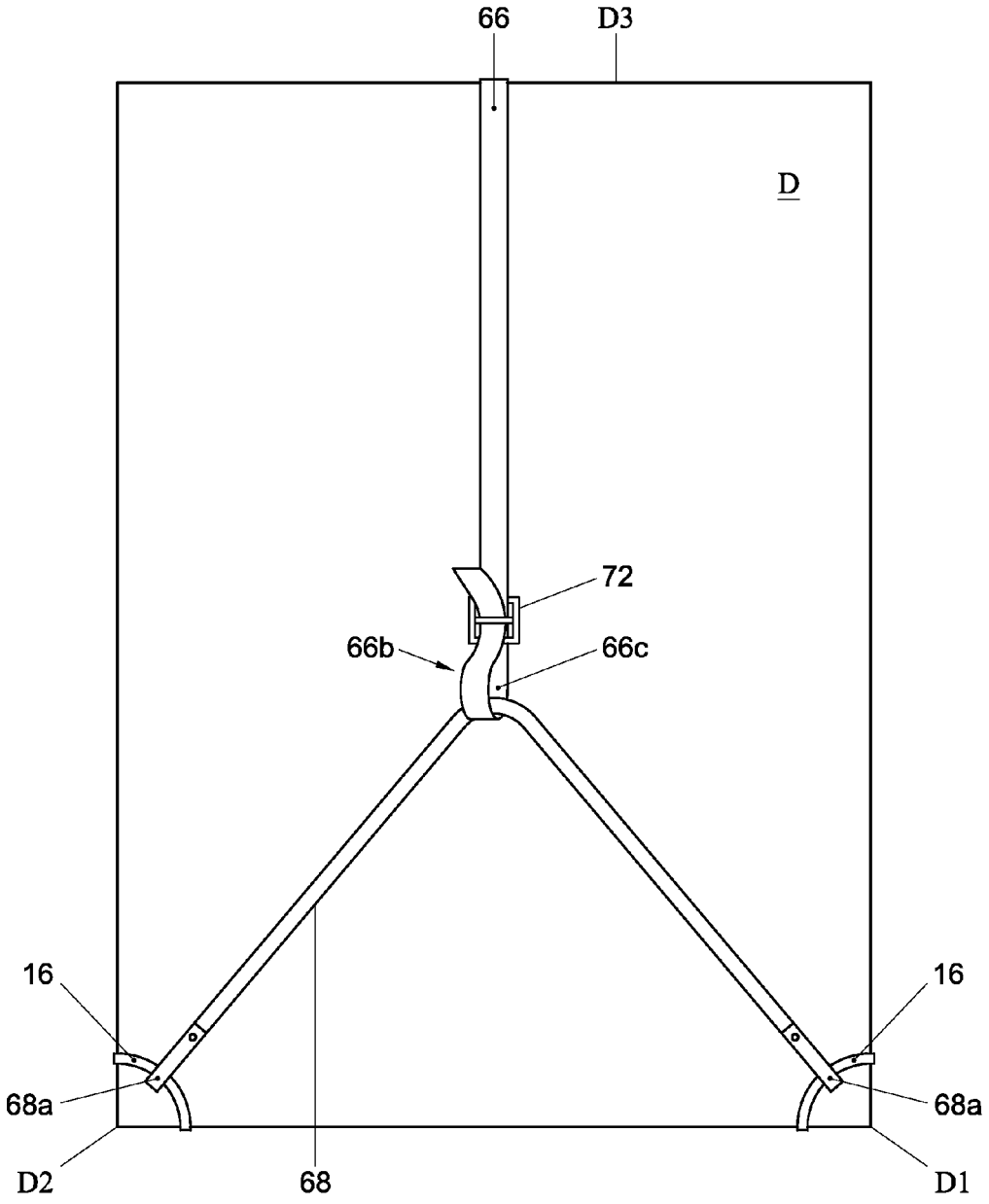
FIG. 10 shows a rear view of the exemplary embodiment of FIG. 9.
Figure 11:
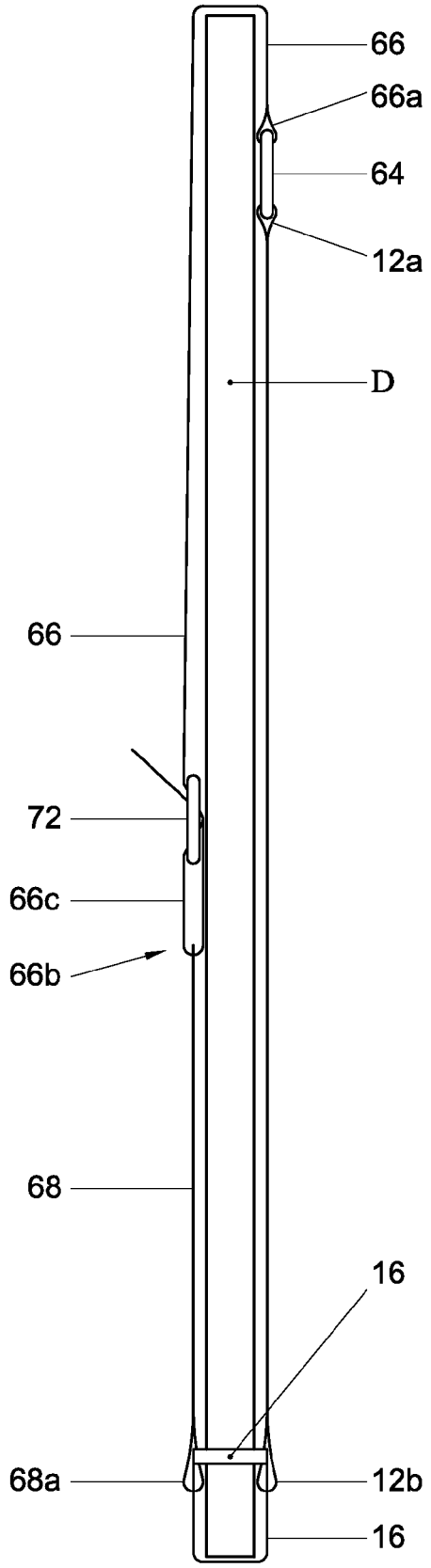
FIG. 11 shows a side-view of the exemplary embodiment of FIG. 9.

In the exemplary embodiment shown in FIGS. 9-11, the pegs 18 are absent and the elastics are designed as endless elastics 16 which, in the set up condition of the illumination assembly, are hooked around the bottom corners D1, D2 of the door.

In an embodiment, of which an example is shown in detail in FIGS. 7 and 8, the light string fastening elements 30 which are configured for connecting the at least one string of lights 14 with the bands 12 can each comprise a first, substantially rectangular body 32 and a second, substantially rectangular body 44. The first body 32 and the second body 44 can be flexibly interconnected via a flexible connecting part. The first body 32 may be provided on a first side 32*a* with a central pin 34 having a sharp point 34*a*, and with fastening pins 36 having a thickened free end 38, the central pin 34 being set up centrally between the two fastening pins 36. A second side 32*b* of the first, substantially rectangular body 32 may be provided with an almost closed eye 40 with an entrance 42, such that a string of lights 14 can be brought via the entrance 42 in the eye 40. The second, substantially rectangular body 44 may be provided with a central opening 46 for receiving the central pin 34 when the light string fastening element 30 is brought into a closed position. The second body 44 can further be provided with two fastening pin receiving provisions 48 provided on either side of the central opening 46, which are designed for receiving and retaining the thickened ends 38 of the fastening pins 36 when the light string fastening element 30 is brought in a closed position. The flexible connecting part is preferably designed such that both in a closed position and in an open position of the light string fastening element 30 the first body 32 and the second body 44 are connected with each other and in the open position can be bent away from each other to bring a band 12 between the two bodies 32, 44. The light string fastening element 30 is preferably manufactured from plastic and of one-piece design. Such a light string fastening element 30 can be mass produced inexpensively, for instance by injection molding.

In a further elaboration, of which an example is shown in FIGS. 7 and 8, the distance between the two fastening pins 36 can be sufficient to receive therebetween an associated band 12 of the illumination assembly 10 in flat, i.e. unfolded, condition. In a closed position of the light string fastening element 30, the central pin 34 extends transversely through the band 12, so that the position of the light string fastening element 30 relative to the band 12 is fixed. As the central pin 34 is provided with a sharp point, the central pin 34 can be simply pricked through the band 12 as the light string fastening element is brought into the closed position.

In an embodiment, of which an example is shown in the figures, the almost closed eye 40 with the entrance 42 can comprise on both sides of the entrance 42 a tapering in-feed guide 52 which has a wide inlet and a narrow exit which terminates in the entrance 42 of the eye 40. With such an in-feed guide 52, insertion of a string of lights 14 into the eye 40 is simplified.

In an embodiment, of which two examples are shown in FIGS. 1-4, the top fastening means can comprise a top fastening element 20. The illumination assembly 10 in this embodiment comprises at least three bands 12, each connected by a first end 12*a* to the top fastening element 20.

In an embodiment, which is a further elaboration of the embodiment described hereinabove, and of which two examples are shown in FIGS. 1-4, in the set up condition, the at least three bands 12, viewed from the top fastening element 20, extend radially outwards in different directions, such that each pair of neighboring bands 12, seen in side view, bounds a triangular area, so that the number of triangular areas corresponds to the number of bands 12.

Figure 2:
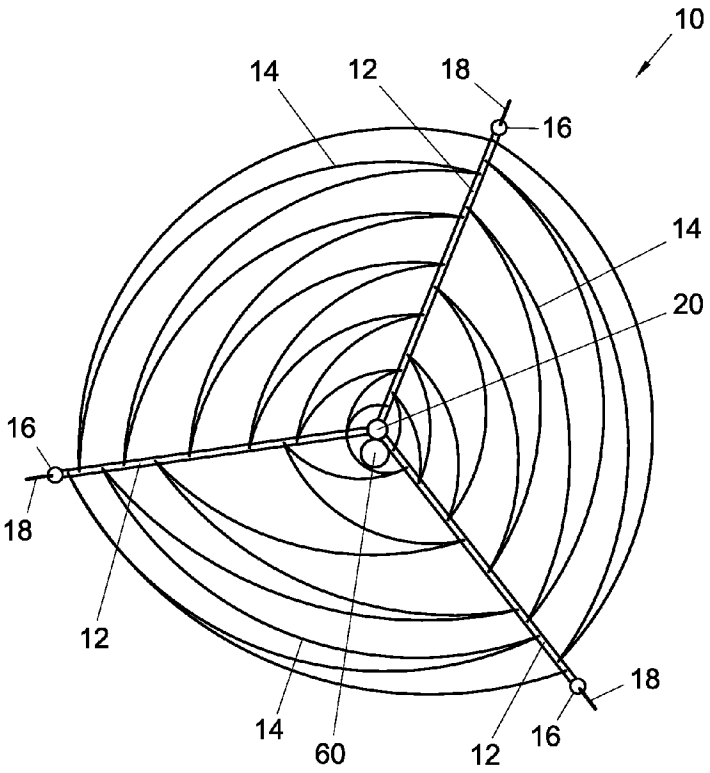
FIG. 2 shows a top plan view of the first exemplary embodiment which is shown in FIG. 1.
Figure 1:
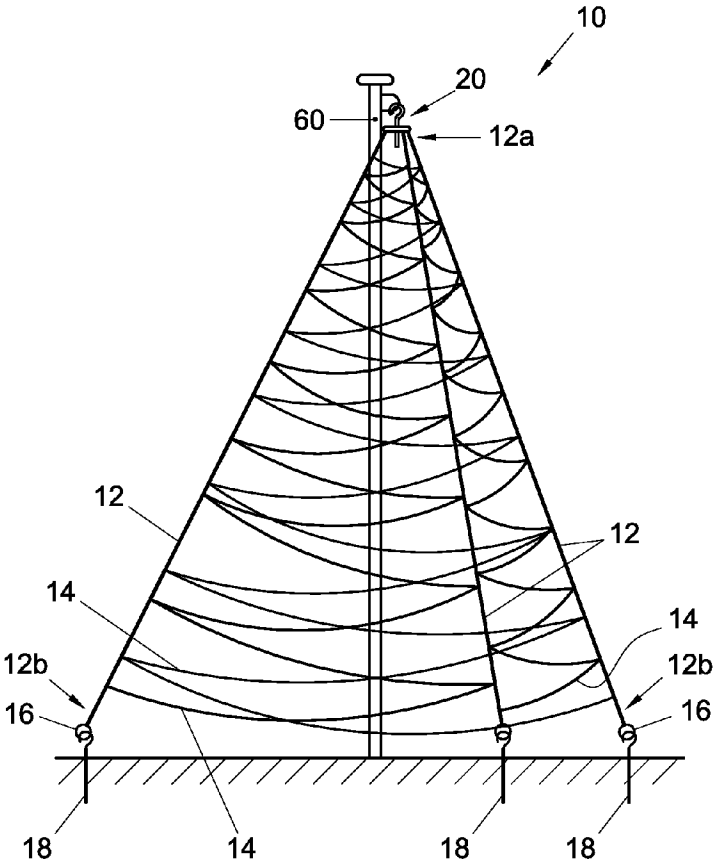
FIG. 1 shows a side view of a first exemplary embodiment.

In the example of FIGS. 1 and 2, the pole 60 is designed as a conventional flagpole with flag hoisting assembly, the top fastening element 20 being attached to the hoisting eye of the hoisting assembly. The illumination assembly 10 shown in that example comprises three bands 12.

Figure 4:
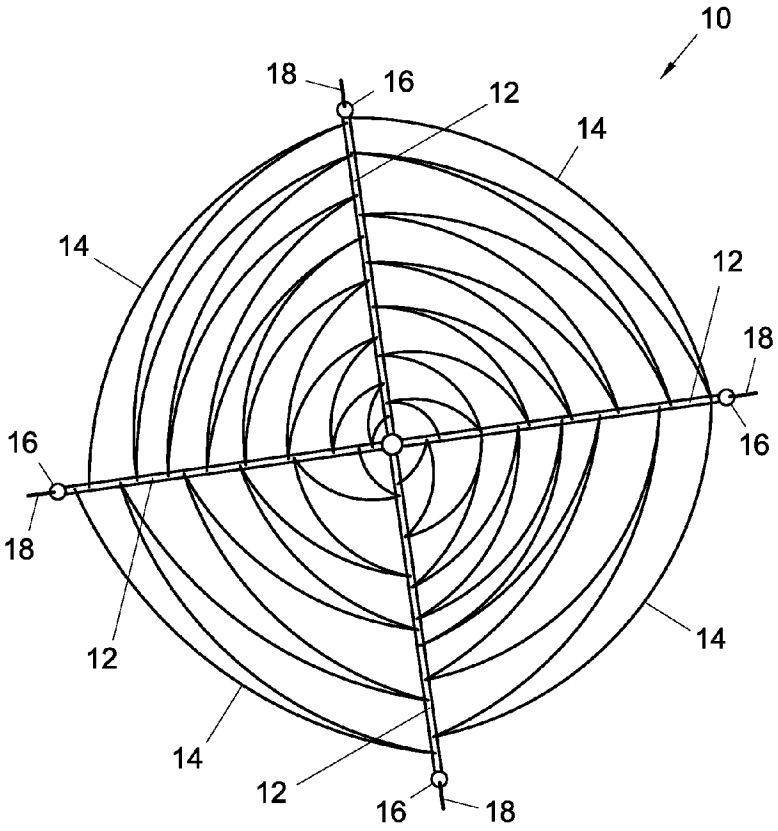
FIG. 4 shows a top plan view of the second exemplary embodiment which is shown in FIG. 3.
Figure 3:
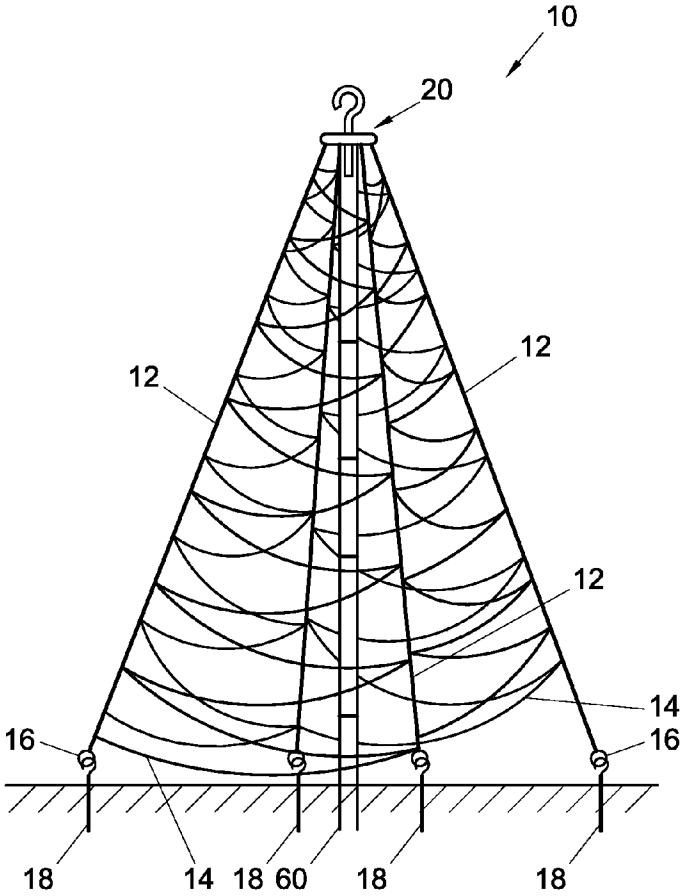
FIG. 3 shows a side view of a second exemplary embodiment.
Figure 5:
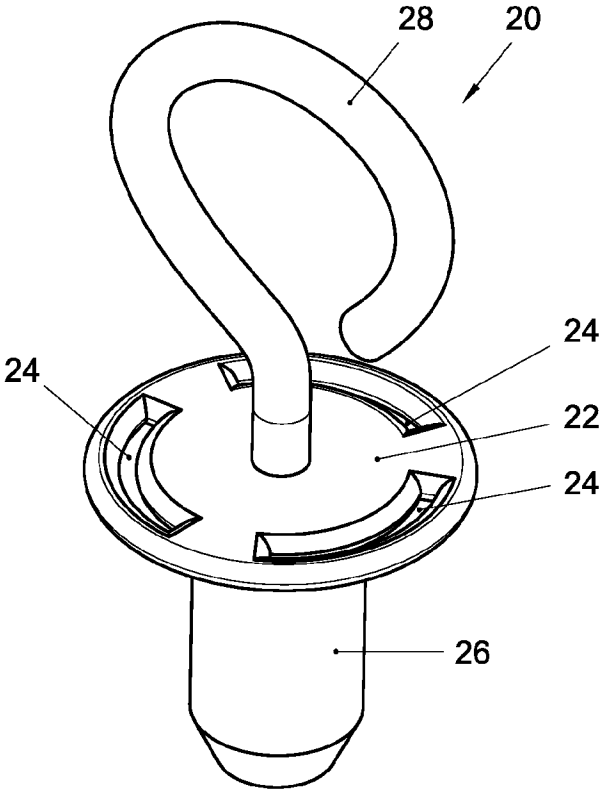
FIG. 5 shows a perspective view of an exemplary embodiment of a top fastening element.

In the example of FIGS. 3 and 4, the pole 60 is designed as a divisible or telescopic pole 60. The top of such a pole 60, preferably supplied along as a part, may be provided with an opening 62 in which the top fastening element 20 can be placed, see also FIG. 6. The example of FIGS. 3 and 4 comprises four bands 12.

The top fastening element can comprise a simple hoisting eye. However, in an embodiment, of which an example is shown in detail in FIGS. 5 and 6, the top fastening element 20 can comprise a body 22 provided with at least one recess 24 to which a first end 12*a* of the band 12 associated with the recess 24 is attached. The number of recesses 24 may correspond to the number of bands 12 with which the illumination assembly is provided, as shown in FIGS. 5 and 6. In an alternative version, the body 22 can also be provided with a single recess 24 or, for instance, fewer recesses 24 than the number of bands 12 of the illumination assembly. In that case, per recess 24, the first ends 12*a* of several bands 12 can be connected via a recess 24 to the body 22. The top fastening element 20 may further comprise a pin 26 extending under the body 22 and a hoisting ring or hoisting hook 28 extending above the body.

When the illumination assembly is raised in an existing flagpole, such a top fastening element 20 can be used while the pin 26 has no function then.

In an alternative embodiment, the illumination assembly 10 can comprise a divisible or telescopic pole 60. In such an embodiment, an upper free end of the pole 60 may be provided with an opening 62 whose diameter is such that the pin 26 of the top fastening element 20 is receivable therein. In that way, the pole 60 does not need to be provided with a hoisting assembly, such as is available with a conventional flagpole for hoisting and lowering the flag, since the pin 26 of the top fastening element 20 can be inserted in an upper part of the divisible pole 60 and then the pole 60 can be further built up by inserting the different parts thereof into each other. Instead of a divisible pole 60, use can also be made of a telescopic pole configured to be slid in and out. It is important that the pole 60 supplied along as a part can also be supplied in a relatively small package.

In an embodiment, of which no example is shown in the figures but which shows a strong similarity to the exemplary embodiment of FIGS. 9-11, the illumination assembly 10 can comprise two bands 12. Each band fastening element that is connected with an associated second end 12*b* is designed as an elastic 16 closed upon itself. Also the top fastening means are designed as an elastic 64 closed upon itself. An elastic closed upon itself is understood to mean an endless elastic. Such an embodiment of the illumination assembly 10 can be set up against a flat surface, such as for instance a wall or window. In the set up condition, the endless elastics 16 and 64 will be hooked around screws or hooks which are mounted on the wall or around hooks which are fastened on the window with suction cups, such that the bands 12 are tautened and enclose a triangular area in which the string of lights 14 extends zigzag between the two bands 12. Such an illumination assembly can be manufactured at a relatively low cost price and provides a fine impression of an illuminated Christmas tree.

If a user wanted to attach an illumination assembly 10 providing the impression of a Christmas tree to a door, he should to that end, in the above described embodiment, provide screws or hooks in the door. Most users are not prepared to do so.

In order to provide that an illumination assembly can be fitted on a door D without damaging the door, an embodiment is provided, of which an example is shown in FIGS. 9-11, which comprises two bands 12, while each band fastening element which is connected with an associated second end 12*b* comprises an endless elastic 16. The top fastening means comprise a strap 66 which has one strap end 66*a* connected directly, or via an elastic 64 or eye, to the first ends 12*a* of the two bands 12. A free, second strap end 66*b* is couplable directly or via a connecting strap 68 to at least one of the endless elastics 16, such that the illumination assembly 10 is fastenable on a door D. In the set up condition of the illumination assembly 10, the bands 12 extend on a front side of the door D. Each endless elastic 16, forming a band fastening element 12, is hooked around a lower corner D1, D2 of the door D, such that between the two bands, the triangular area mentioned extends. The strap 66 has been passed over an upper side D3 of the door D and extends downwards from this upper side on a rear side of the door D. The strap 66 is coupled directly or via the connecting strap 68 to at least one of the elastics 16 closed upon themselves. Such an embodiment of the illumination assembly 10 can be fastened on the door D without damaging the door D. For this embodiment too, it holds that it can be manufactured at relatively low cost.

In a further elaboration of this embodiment, of which an example is shown in FIGS. 9-11, the strap 66 may be provided at the second strap end 66*b* with a loop 66*c*. In this embodiment, the illumination assembly 10 may be provided with a connecting strap 68 which extends through the loop 66*c* and which has two free connecting strap ends comprising openable and closable loops 68*a*, with the aid of which the connecting strap ends 68*a* can be connected with the endless elastics 16. Such an embodiment enables a rapid and simple mounting of the illumination assembly 10.

In an embodiment, of which an example is shown in FIGS. 9-11, the length of the strap 66 is settable, such that the illumination assembly 10 is mountable on doors of different dimensions.

To that end, for instance, the loop 66*c* of the strap 66 may be formed by folding over the end 66*b* of the strap 66 and fastening it via a strap clasp 72 to the strap 66. By adjustment of the loop 66*c* in the strap clasp 72, the length of the strap 66 can be simply set, so that the illumination assembly 10 can be fastened onto doors D of different dimensions.

In order to give the shape of the triangular area bounded by the two bands 12 a fixed form, in an embodiment, of which an example is shown in FIGS. 9-11, between the second ends 12*b*, further a base band 70 may extend which bounds the base of the triangular area and, together with the two bands 12, defines the shape of the triangular area. What is accomplished in such an embodiment is that the shape of the triangular area is fixedly determined and that therefore the string of lights 14 also extends in the correct manner, i.e., garland-wise and zigzag, between the two bands 12.

It is noted that the top fastening element 20 as defined in claim 4 also embodies, independently of the subject matter of claim 1, an independent invention which could become part of a divisional patent application.

It is further noted that the light string fastening element 30 as defined in claims 5-7 also embodies, independently of the subject matter of claim 1, an independent invention which could become part of a divisional patent application.

For instance, the light string fastening elements 30 could be utilized in an illumination assembly as known from EP 1 710 772 (B1) instead of the loops and press studs disclosed in that publication. The top fastening element 20 can also be utilized in such an illumination assembly known from EP'772, instead of the hoisting ring disclosed therein.

The invention is not limited to the examples which are shown in the figures. The embodiments as claimed in the subclaims and which have been described hereinabove with reference to the drawing can also be executed in a different way. The embodiments can be combined with each other in different manners and also be utilized independently of each other. The reference numerals in the claims are only used in elucidation, but do not limit the claims.

The invention claimed is:

1. An illumination assembly for providing a Christmas tree impression, the illumination assembly comprising:

at least two bands each having a first end and a second end, wherein the at least two bands in a set up condition of the illumination assembly extend from a common apical range, in which the first ends of the at least two bands are located, in downward direction and, viewed from the apical range, extend away from each other, such that two neighboring bands, seen in side view of the illumination assembly, bound a triangular area;

at least one string of lights which, in the set up condition of the illumination assembly, extends zigzag in the associated triangular area between two neighboring bands of said at least two bands, while the at least one string of lights is connected with those two neighboring bands;

light string fastening elements which are configured for connecting the at least one string of lights with the bands;

band fastening elements which are each connected with an associated second end of the at least two bands; and a top fastening mechanism configured to position the first ends of the at least two bands relative to a fixed external object, such that the apical range in the set up condition is at a particular level above the ground, wherein the illumination assembly is arranged to be brought from a packaged condition to the set up condition and vice versa, and wherein in the set up condition the at least two bands are held in a tensed condition with the aid of the band fastening elements, the second ends are connected via the band fastening elements to a fixed object, and the top fastening mechanism is connected with a fixed object, wherein the light string fastening elements which are configured for connecting the at least one string of lights with the bands each comprise:

a first, substantially rectangular body which on a first side is provided with a central in having a sharp point, and fastening pins having a thickened free end, wherein the central in is arranged centrally between the two fastening pins, and wherein a second side of the first, substantially rectangular body is provided with an almost closed eye with an entrance, such that a string of lights can be brought via the entrance into the eye;

a second, substantially rectangular body, which is provided with a central opening for receiving the central in when the light string fastening element is brought in a closed position, and two fastening in receiving provisions provided on either side of the central opening and which are configured for receiving and retaining the thickened ends of the fastening pins when the light string fastening element is brought in a closed position; and a flexible connecting part which flexibly connects the first body with the second body, such that both in the closed position and in an open position of the light string fastening element the first body and the second body are connected with each other and in the open condition can be bent away from each other to bring a band between the two bodies, and wherein the light string fastening element is manufactured from plastic and is of one-piece design.

2. The illumination assembly according to claim 1, wherein each band fastening element comprises an elastic, wherein the elastic is connected with the second end of the associated band.

3. The illumination assembly according to claim 2, wherein at least a number of the band fastening elements also comprise a tent peg, wherein the at least one peg in a set up condition of the illumination assembly engages an associated elastic.

4. The illumination assembly according to claim 1, wherein the distance between the two fastening pins is sufficient to receive therebetween an associated band of the illumination assembly in a flat condition, wherein, in a closed position of the light string fastening element, the central pin extends transversely through the band, so that the position of the light string fastening element relative to the band is fixed.

5. The illumination assembly according to claim 1, wherein the almost closed eye with the entrance comprises on either side of the entrance a tapering in-feed guide having a wide inlet and a narrow exit which terminates in said entrance of the eye.

6. The illumination assembly according to claim 1, wherein the top fastening means comprise a top fastening element, wherein the illumination assembly comprises at least three bands which are each connected by a first end with the top fastening element.

7. The illumination assembly according to claim 6, wherein the at least three bands in the set up condition, viewed from the top fastening element, extend away radially outwards in different directions, so that each pair of neighboring bands, seen in side view, bounds a said triangular area, so that the number of triangular areas corresponds to the number of bands.

8. The illumination assembly according to claim 6, wherein the top fastening element comprises:

a body provided with at least one recess to which a first end of the band associated with the at least one recess is attached, or to which the first ends of the at least three bands are attached;

a pin extending under the body; and a hoisting ring or hoisting hook extending above the body.

9. The illumination assembly according to claim 1, wherein the illumination assembly comprises a divisible or telescopic pole.

10. The illumination assembly according to claim 8, wherein the illumination assembly comprises a divisible or telescopic pole, and wherein an upper free end of the pole is provided with an opening whose diameter is such that therein the pin of the top fastening element is receivable.

11. The illumination assembly according to claim 2, provided with two bands, wherein each band fastening element connected with an associated second end comprises an elastic closed upon itself, wherein the top fastening mechanism comprises an elastic closed upon itself.

12. The illumination assembly according to claim 4, wherein the almost closed eye with the entrance comprises on either side of the entrance a tapering in-feed guide having a wide inlet and a narrow exit which terminates in said entrance of the eye.

13. The illumination assembly according to claim 2, wherein the top fastening means comprise a top fastening element, wherein the illumination assembly comprises at least three bands which are each connected by a first end with the top fastening element.

14. An illumination assembly for providing a Christmas tree impression, the illumination assembly comprising:

at least two bands each having a first end and a second end, wherein the at least two bands in a set up condition of the illumination assembly extend from a common apical range, in which the first ends of the at least two bands are located, in downward direction and, viewed from the apical range, extend away from each other, such that two neighboring bands, seen in side view of the illumination assembly, bound a triangular area;

at least one string of lights which, in the set up condition of the illumination assembly, extends zigzag in the associated triangular area between two neighboring bands of said at least two bands, while the at least one string of lights is connected with those two neighboring bands;

light string fastening elements which are configured for connecting the at least one string of lights with the bands;

band fastening elements which are each connected with an associated second end of the at least two bands; and a top fastening mechanism configured to position the first ends of the at least two bands relative to a fixed external object, such that the apical range in the set up condition is at a particular level above the ground, wherein the illumination assembly is arranged to be brought from a packaged condition to the set up condition and vice versa, and wherein in the set up condition the at least two bands are held in a tensed condition with the aid of the band fastening elements, the second ends are connected via the band fastening elements to a fixed object, and the top fastening mechanism is connected with a fixed object, and wherein the at least two band comprises two bands, wherein each band fastening element connected with an associated second end comprises an endless elastic, wherein the top fastening mechanism comprise a strap, which has a first strap end connected directly or via an elastic or eye with the first ends of the two bands, wherein a free, second strap end is couplable directly or via a connecting strap with at least one of the endless elastics, such that the illumination assembly is fastenable on a door, wherein the bands extend on a front side of the door, wherein each endless elastic is hooked around a lower corner of the door, such that between the two bands said triangular area extends, and wherein the strap has been passed over an upper side of the door and extends from that upper side downwards on a rear side of the door and is coupled directly, or via the connecting strap, with at least one of the elastics closed upon themselves.

15. The illumination assembly according to claim 14, wherein the strap at the second strap end is provided with a loop, wherein the illumination assembly is provided with a connecting strap which extends through the loop and which has two free connecting strap ends which comprise openable and closable loops with the aid of which the connecting strap ends can be connected with the endless elastics.

16. The illumination assembly according to claim 14, wherein the length of the strap is settable, such that the illumination assembly is mountable on doors of different dimensions.

17. The illumination assembly according to claim 14, wherein between the second ends a base band extends which bounds the base of the triangular area and determines the shape of the triangular area together with said two bands.

18. The illumination assembly according to claim 14, wherein the light string fastening elements which are configured for connecting the at least one string of lights with the bands each comprise:

a first, substantially rectangular body which on a first side is provided with a central pin having a sharp point, and fastening pins having a thickened free end, wherein the central pin is arranged centrally between the two fastening pins, and wherein a second side of the first, substantially rectangular body is provided with an almost closed eye with an entrance, such that a string of lights can be brought via the entrance into the eye;

a second, substantially rectangular body, which is provided with a central opening for receiving the central pin when the light string fastening element is brought in a closed position, and two fastening pin receiving provisions provided on either side of the central opening and which are configured for receiving and retaining the thickened ends of the fastening pins when the light string fastening element is brought in a closed position; and a flexible connecting part which flexibly connects the first body with the second body, such that both in the closed position and in an open position of the light string fastening element the first body and the second body are connected with each other and in the open condition can be bent away from each other to bring a band between the two bodies, wherein the light string fastening element is manufactured from plastic and is of one-piece design.

* * * * *